US005184782A

United States Patent [19]

Kerstges et al.

[11] Patent Number: 5,184,782

[45] Date of Patent: Feb. 9, 1993

[54] TUBLAR MILL

[75] Inventors: Johannes Kerstges; Hubert Brosdetzko, both of Oberhausen, Fed. Rep. of Germany

[73] Assignee: Deutsche Babcock Energie- und Umwelttechnik AG, Oberhausen, Fed. Rep. of Germany

[21] Appl. No.: 774,530

[22] Filed: Oct. 8, 1991

[30] Foreign Application Priority Data

Oct. 9, 1990 [DE] Fed. Rep. of Germany ..... 4031928

[51] Int. Cl.[5] ..... B02C 17/00

[52] U.S. Cl. ..... 241/171; 241/23

[58] Field of Search ..... 241/18, 23, 153, 171

[56] References Cited

U.S. PATENT DOCUMENTS 2,189,312 2/1940 Frisch ..... 241/171 X
2,285,429 6/1942 Frisch ..... 241/171 X
4,744,523 3/1988 Ortega De La Orden ..... 241/171

*Primary Examiner*—Douglas D. Watts
*Attorney, Agent, or Firm*—Max Fogiel

[57] ABSTRACT

A tube mill with a cylindrical jacket (1) terminating at each end in a conical wall (2). The wall merges into a neck (3). A tube (6) is accommodated at a radial interval in a stationary milling-stock intake-and-outlet housing (5). The tube is attached to the neck. The tube is surrounded by a feed screw (12). The screw's threads (13) are loosely attached to the tube. The screw is connected to a shaft (9). The shaft is mounted in a bearing (18) outside the mill. The object is to improve the suspension of the feed screw to the extent that the bearing will be able to accommodate eccentric rotation by, and sudden and uncontrolled stresses on, the screw along with axial displacements of the shaft. The housing (19) for the bearing is accordingly surrounded at a radial interval by a continuous ring (22). The housing rests against the ring by way of several tensioned springs (23) uniformly distributed around the circumference of the housing.

7 Claims, 3 Drawing Sheets

TUBLAR MILL

BACKGROUND OF THE INVENTION

Tube mills are employed in particular to mill-dry coal (VGB Kraftwerkstechnik 67 [1987], 12, 1185–92). Air is pumped through the tube inside into the milling area while raw coal is supplied, and the milled coal is removed while suspended in air through the annular space around the tube. The raw coal is supplied to the milling area with a feed screw that rotates along with the tube. The screw's threads are loosely attached to the tube by chains. The tube and screw are connected to a shaft mounted in a loose bearing outside the mill. The bearing must be able to accommodate axial displacements of the shaft, thrusts, and impacts, and eccentricities on the part of the loosely suspended screw.

SUMMARY OF THE INVENTION

The object of the invention is to improve the suspension of the feed screw in the generic mill to the extent that the bearing will be able to accommodate eccentric rotation by, and sudden and uncontrolled stresses on, the screw along with axial displacements of the shaft.

Any stresses, impacts, and thrusts that the screw transmits to the shaft will be accommodated by the springs and forwarded to the supporting ring. The bearing itself will accordingly be extensively relieved of irregular stresses and can be a roller bearing. A roller bearing of this type is more effective in accommodating static stress from the tube mill than a friction bearing, although the latter type might seem desirable given a tube mill's low rate of rotation. Friction bearings lose true as they wear, however, and cannot be permanently lubricated. The bearing must be relubricated, which is not only expensive but allows fresh lubricant to be forced out at the end.

BRIEF DESCRIPTION OF THE DRAWINGS

One embodiment of the invention will now be described by way of example with reference to the accompanying drawing, wherein.

DESCRIPTION OF THE PREFERRED EMBODIMENTS

Figure 1:
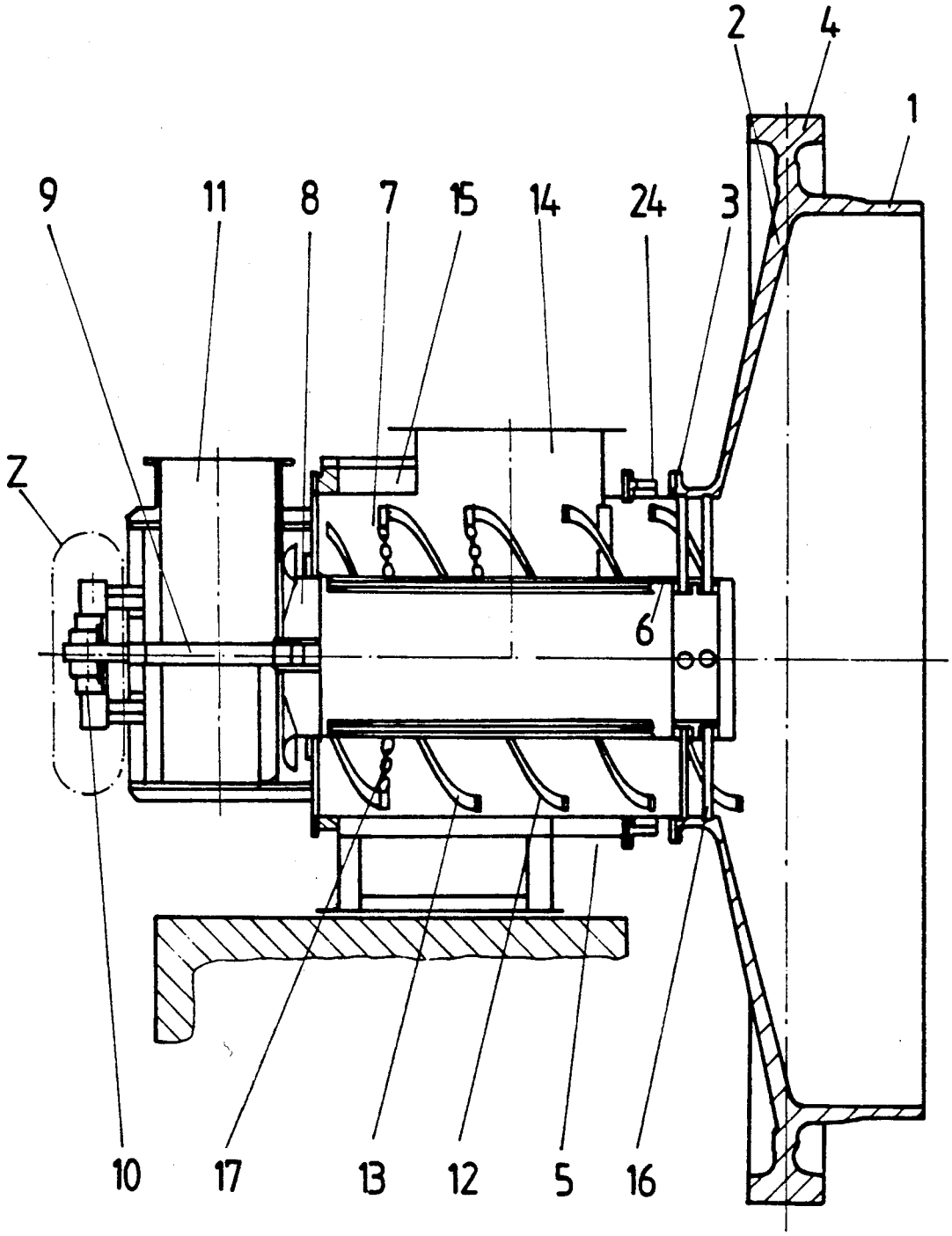
FIG. 1 is a longitudinal section through a tube mill.

A tube mill for grinding and drying raw coal has a cylindrical jacket 1, only part of which is illustrated. Each end of jacket 1 merges into a conical wall 2. Each wall merges into a neck 3. A bearing race 4 extends around the transition between jacket 1 and wall 2.

Jacket 1, wall 2, and neck 3 all rotate together. The neck communicates with a stationary intake-and-outlet housing 5. The joint between neck 3 and housing 5 is sealed off by a gasket 24. Inside neck 3 and intake-and-outlet housing 5 is a tube 6 surrounded by an annular space 7. Tube 6 is secured at the end facing jacket 1 to rotating neck 3 in a stationary bearing by screws 16 and at the end facing away from the jacket to a shaft 9 by webs 8. Shaft 9 rotates in a suspension 10 in the form of a lose bearing outside the mill. Hot air or gas is supplied to the mill through a channel 11 and arrives in the milling area by way of tube 6.

An intake 14 and an outlet 15 for milling stock communicate with stationary intake-and-outlet housing 5 and open into the annular space 7 between the housing and tube 6. Accommodated in annular space 7 is a feed screw 12. Its threads 13 are loosely attached to tube 6 by way of chains 17. The entering raw coal is forwarded by feed screw 12 through the bottom of annular space 7 into the milling area. The coal dust is removed while suspended in the air through annular space 7 in the opposite direction. The arrows in FIG. 1 indicate the directions of flow.

Figure 2:
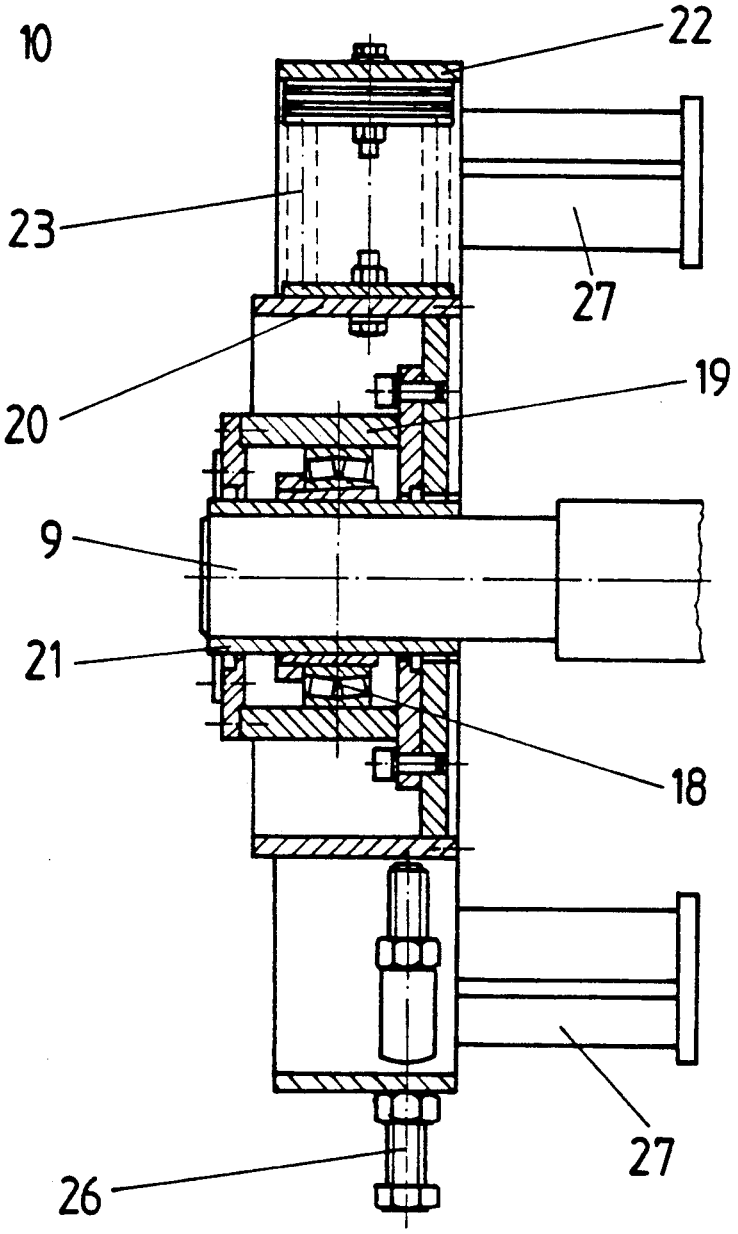
FIG. 2 is a large-scale representation of the detail Z in FIG. 1.
Figure 3:
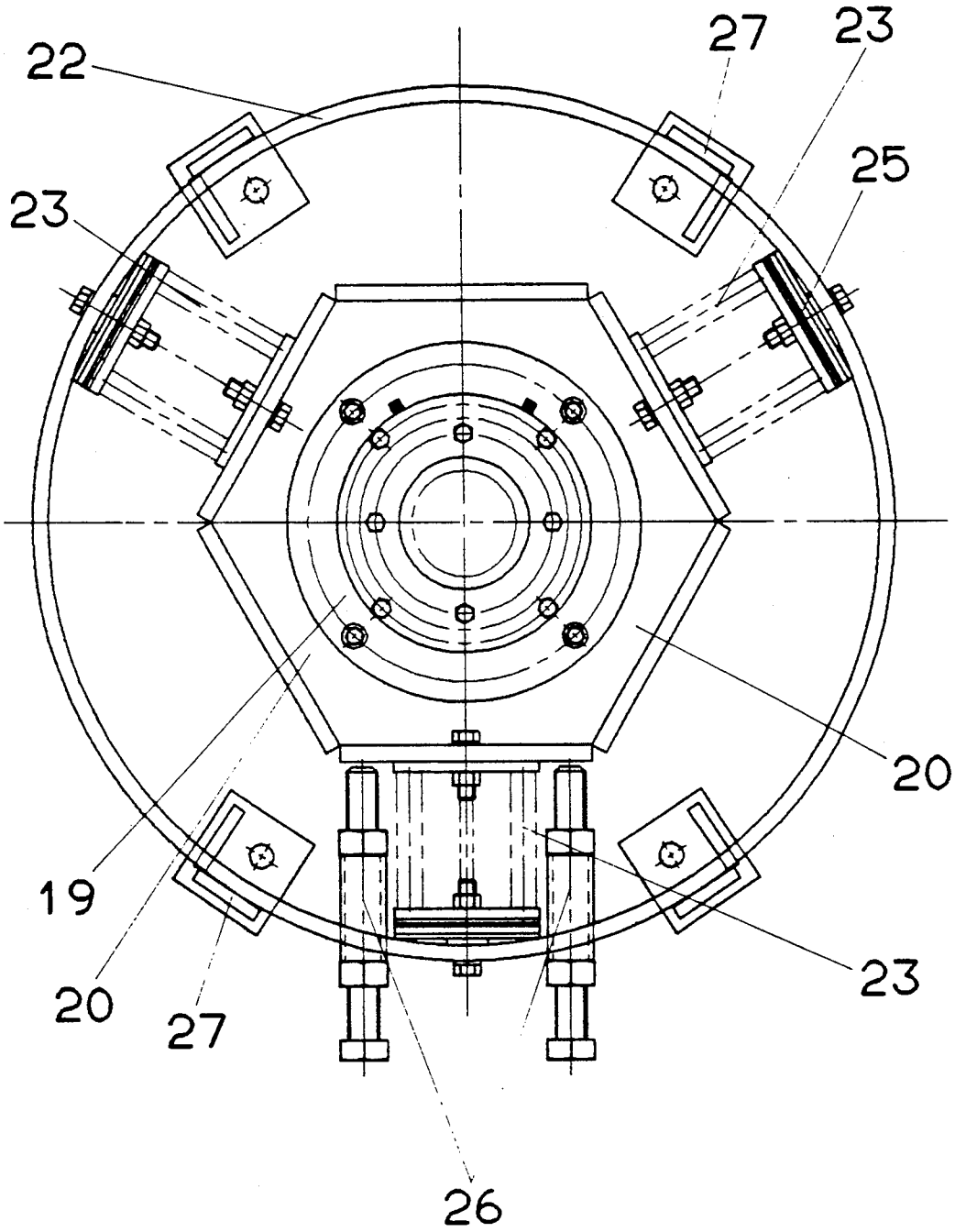
FIG. 3 is a side view of the situation illustrated in FIG. 2.

The loose suspension of feed screw 12 from tube 6 prevents the raw coal from jamming up as it travels through annular space 7. Any consequent irregular and uncontrollable stresses acting radially on feed screw 12 and any eccentricities are transmitted by shaft 9, which is connected to feed screw 12 by way of webs 8, tube 6, and chains 17, to suspension 10. To keep such irregular stress away from the bearing, suspension 10 is designed as illustrated in FIGS. 2 and 3 and as will now be explained.

Suspension 10 functions like a loose bearing and comprises a roller bearing 18, preferably a two-row self-aligning bearing. Bearing 18 is accommodated in a housing 19 surrounded by a wall 20. The wall demarcates a regular-hexagonal prism. Between shaft 9 and bearing 18 is a heat-insulating ceramic bush 21 that keeps heat from the tube mill away from bearing 18.

Housing 19 is surrounded at a radial distance by a continuous ring 22. Several springs 23 are distributed around housing 19 between ring 22 and the wall 20 of the housing. The springs are helical. Housing 19 rests on ring 22 by way of springs 23, and the ring is connected to the stationary section of the mill by way of holders 27.

Springs 23 are tensioned to generate a radial outward displacement of a prescribed extent. The degree of tension can be adjusted by inserting washers 25 between springs 23 and ring 22.

There are preferably three springs 23, distributed at an angle of 120° and each resting against one face of hexagonal-prism wall 20. One spring 23 is positioned under bearing 18, with the associated face of wall 20 being horizontal. On each side of this spring, a threaded bolt 26 is secured in ring 22. The inward-facing end of each bolt 26 is slightly remote from the horizontal face of wall 20. The interval can be varied by adjusting bolts 26 to prevent screw 12 from getting out of control.

We claim:

1. A tube mill comprising: a cylindrical jacket with two ends; a conical wall at each of said ends; a neck portion merging into said conical wall; a stationary intake-and-outlet housing connected to said neck portion; a tube radially spaced within said intake-and-outlet housing; a feed screw surrounding said tube and having threads loosely attached to said tube; a shaft connected to said feed screw; bearing means outside said mill and mounting said shaft; bearing housing with a circumference for holding said bearing means; a continuous ring surrounding said bearing housing at a spaced distance therefrom; and a plurality of tensioned springs between said continuous ring and said bearing housing, said springs being uniformly distributed around the circumference of said bearing housing.

2. A tube mill as defined in claim 1, wherein said bearing means comprises a tow-row self-aligning roller bearing.

3. A tube mill as defined in claim 2, including a ceramic bushing between said shaft and said self-aligning roller bearing.

4. A tube mill as defined in claim 1, including a wall around said bearing housing and having a shape of a regular-hexagonal prism with sides, one of said springs resting against every other one of said sides of said prism.

5. A tube mill as defined in claim 1, including an adjustable stop, one of said springs being under said bearing means and having an operative range dependent on said adjustable stop.

6. A tube mill as defined in claim 5, wherein said one spring under said bearing means rests against a horizontal side of said wall around said bearing housing; a threaded bolt on each side of said one spring and having an end; a securing ring for securing said threaded bolt in said securing ring; said springs having a variable operative range maintained between said bolt end and said horizontal side of said wall.

7. A tube mill comprising: a cylindrical jacket with two ends; a conical wall at each of said ends; a neck portion merging into said conical wall; a stationary intake-and-outlet housing connected to said neck portion; a tube radially spaced within said intake-and-outlet housing; a feed screw surrounding said tube and having threads loosely attached to said tube; a shaft connected to said feed screw; bearing means outside said mill and mounting said shaft; bearing housing with a circumference for holding said bearing means; a continuous ring surrounding said bearing housing at a spaced distance therefrom; and a plurality of tensioned springs between said continuous ring and said bearing housing, said springs being uniformly distributed around the circumference of said bearing housing; said bearing means comprising a two-row self-aligning roller bearing; a ceramic bushing between said shaft and said self-aligning roller bearing; a wall around said bearing housing and having a shape of a regular-hexagonal prism with sides, one of said springs resting against every other one of said sides of said prism; an adjustable stop, one of said springs being under said bearing means and having an operative range dependent on said adjustable stop; said one spring under said bearing means resting against a horizontal side of said wall around said bearing housing; a threaded bolt on each side of said one spring and having an end; an securing ring for securing said threaded bolt in said securing ring; said springs having a variable operative range maintained between said bolt end and said horizontal side of said wall.

* * * * *